US011697060B2

(12) United States Patent
Sias

(10) Patent No.: US 11,697,060 B2
(45) Date of Patent: Jul. 11, 2023

(54) TABLETOP DRINKING GAME APPARATUS

(71) Applicant: David Sias, Chicago, IL (US)

(72) Inventor: David Sias, Chicago, IL (US)

( * ) Notice: Subject to any disclaimer, the term of this patent is extended or adjusted under 35 U.S.C. 154(b) by 51 days.

(21) Appl. No.: 17/389,089

(22) Filed: Jul. 29, 2021

(65) Prior Publication Data

US 2022/0032172 A1 Feb. 3, 2022

Related U.S. Application Data

(60) Provisional application No. 63/059,543, filed on Jul. 31, 2020.

(51) Int. Cl.

| | |
|---|---|
| ***A63F 9/24*** | (2006.01) |
| ***A63F 9/00*** | (2006.01) |
| ***B67D 3/00*** | (2006.01) |

(52) U.S. Cl.

CPC ..... *A63F 9/24* (2013.01); *A63F 9/001* (2013.01); *B67D 3/0003* (2013.01); *B67D 3/008* (2013.01); *B67D 3/0077* (2013.01); *B67D 3/0096* (2013.01); *A63F 2009/0053* (2013.01); *A63F 2009/2408* (2013.01); *A63F 2009/2454* (2013.01); *A63F 2009/2479* (2013.01); *A63F 2250/024* (2013.01); *B67D 2210/00068* (2013.01)

(58) Field of Classification Search

CPC .... A63F 9/24; A63F 9/001; A63F 2009/0053; A63F 2009/2408; A63F 2009/2454; A63F 2009/2479; A63F 2250/024; A63F 2009/0012; A63F 2250/144; B67D 3/0003; B67D 3/0077; B67D 3/008; B67D 3/0096; B67D 2210/00068

See application file for complete search history.

(56) References Cited

U.S. PATENT DOCUMENTS

| | | | | | |
|---|---|---|---|---|---|
| 250,500 | A | * | 12/1881 | Chewning | B67C 3/22 141/129 |
| 553,734 | A | * | 1/1896 | Iredale | B65B 3/32 137/881 |
| 858,051 | A | * | 6/1907 | Allen | B65B 3/32 141/242 |

(Continued)

FOREIGN PATENT DOCUMENTS

| | | | |
|---|---|---|---|
| GB | 2455115 | A | 6/2009 |
| WO | WO2001056671 | A1 | 8/2001 |

*Primary Examiner* — Bob Zadeh

(57) ABSTRACT

A tabletop drinking game apparatus includes a base, a tower, a plurality of dispensing units, a reservoir, a microcontroller, and a power source. The tower is concentrically attached to the base as the reservoir is concentrically connected to the tower, opposite of the base. Each user is able to enter their input command through a pair of control buttons of the base. The plurality of dispensing units is radially mounted around the tower and is in fluid communication with the reservoir so that the stored beverage can be dispensed according to the outcomes of the game. The power source is electrically connected to control buttons, the plurality of dispensing units, and the microcontroller to initiate the game play. The microcontroller is electronically connected to the plurality of dispensing units as the microcontroller determines the outcome of the game play.

7 Claims, 7 Drawing Sheets

(56) References Cited

U.S. PATENT DOCUMENTS

| | | | | |
|---|---|---|---|---|
| 2,827,210 | A * | 3/1958 | Ballard | A47G 33/02 D7/308 |
| 5,168,905 | A * | 12/1992 | Phallen | B65B 3/36 141/237 |
| 5,381,839 | A * | 1/1995 | Dowd | B65B 3/30 141/237 |
| 5,484,002 | A * | 1/1996 | Kupietzky | B67D 3/00 141/237 |
| 10,273,136 | B1 * | 4/2019 | Briley | B67D 3/0029 |
| 2005/0116413 | A1 | 6/2005 | Wagner | |
| 2009/0069949 | A1 * | 3/2009 | Carpenter | B67D 1/0021 222/144.5 |
| 2012/0037008 | A1 * | 2/2012 | Rodriguez | A47J 31/401 99/289 R |
| 2019/0232136 | A1 | 8/2019 | Krause | |
| 2020/0118392 | A1 | 4/2020 | Furlong | |
| 2022/0032172 | A1 * | 2/2022 | Sias | B67D 3/008 |

* cited by examiner

TABLETOP DRINKING GAME APPARATUS

The current application claims a priority to the U.S. Provisional Patent application Ser. No. 63/059,543 filed on Jul. 31, 2020.

FIELD OF THE INVENTION

The present invention relates generally to a field of amusement devices. More specifically, the present invention is an apparatus that facilitates a tabletop drinking game for any type of beverage.

BACKGROUND OF THE INVENTION

Existing beverage drinking games mainly target young adults and adults and generally requires some kind of game boards, mobile phones, or other game related elements. However, existing technologies for facilitating a drinking game are deficient with regard to several aspects. For instance, current technologies do not provide controlled dispensing of liquid for drinking based on an outcome of a game. In other words, all of the existing drinking games rely on the players to dispense of beverage based on the outcome of the game. This can sometimes lead into disagreements and altercation.

It is therefore an objective of the present invention to provide a tabletop drinking game apparatus that may overcome one or more of the above-mentioned problems and/or limitations. The present invention provides a simple set of rules so that the game can be played by many different age groups as all input commands entered via a pair of buttons by each player. Furthermore, a microcontroller of the present invention completes the dispense of beverage thus removing the human interaction. As a result, the present invention is able to provide a fun and interactive tabletop drinking game for children, young adults, and adults.

DETAIL DESCRIPTIONS OF THE INVENTION

Figure 1:
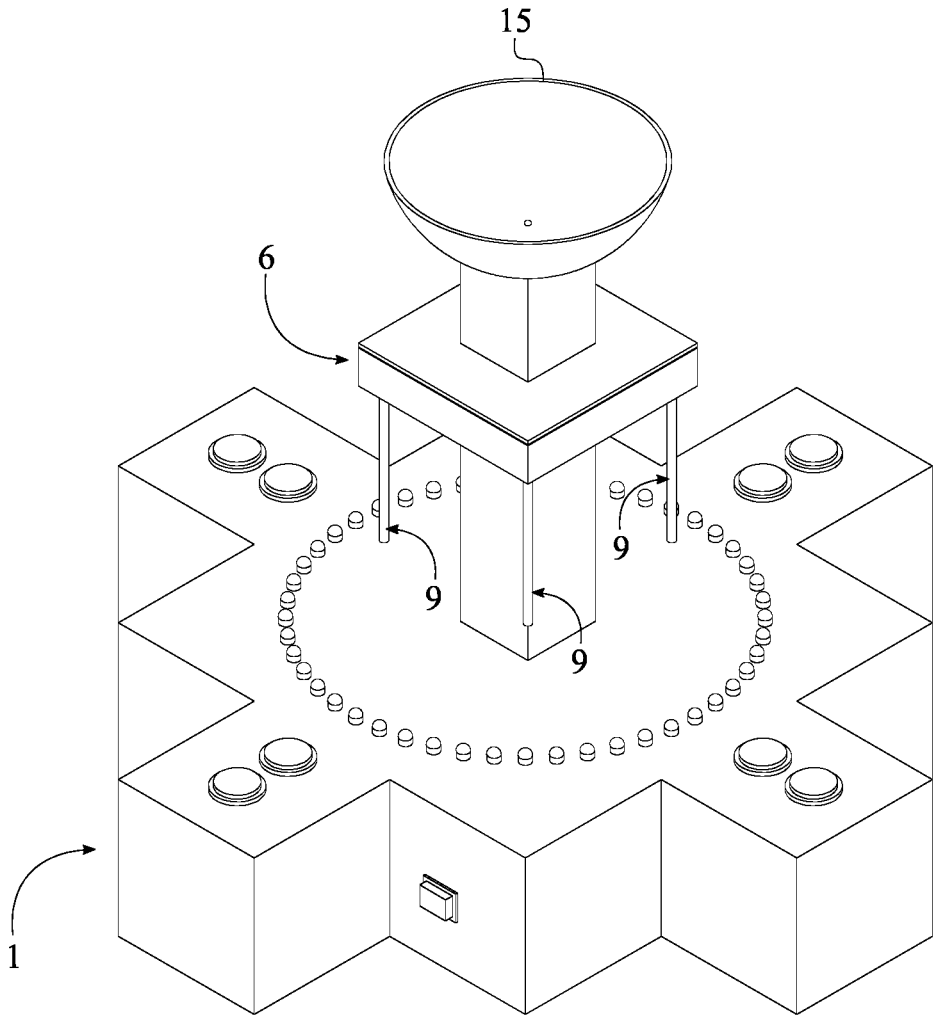
FIG. 1 is a perspective view of the present invention.

All illustrations of the drawings are for the purpose of describing selected versions of the present invention and are not intended to limit the scope of the present invention.

The present invention is a tabletop drinking game apparatus that automatically completes dispensing of beverage after each completed round of gameplay. As a result, the present invention does not rely on players to dispense a beverage thus eliminating disagreements and altercation caused by human errors. The present invention comprises of a base 1, a tower 6, a plurality of dispensing units 9, a reservoir 15, a microcontroller 16, and a power source 18 as shown in FIG. 1 and FIG. 6-7.

Figure 2:
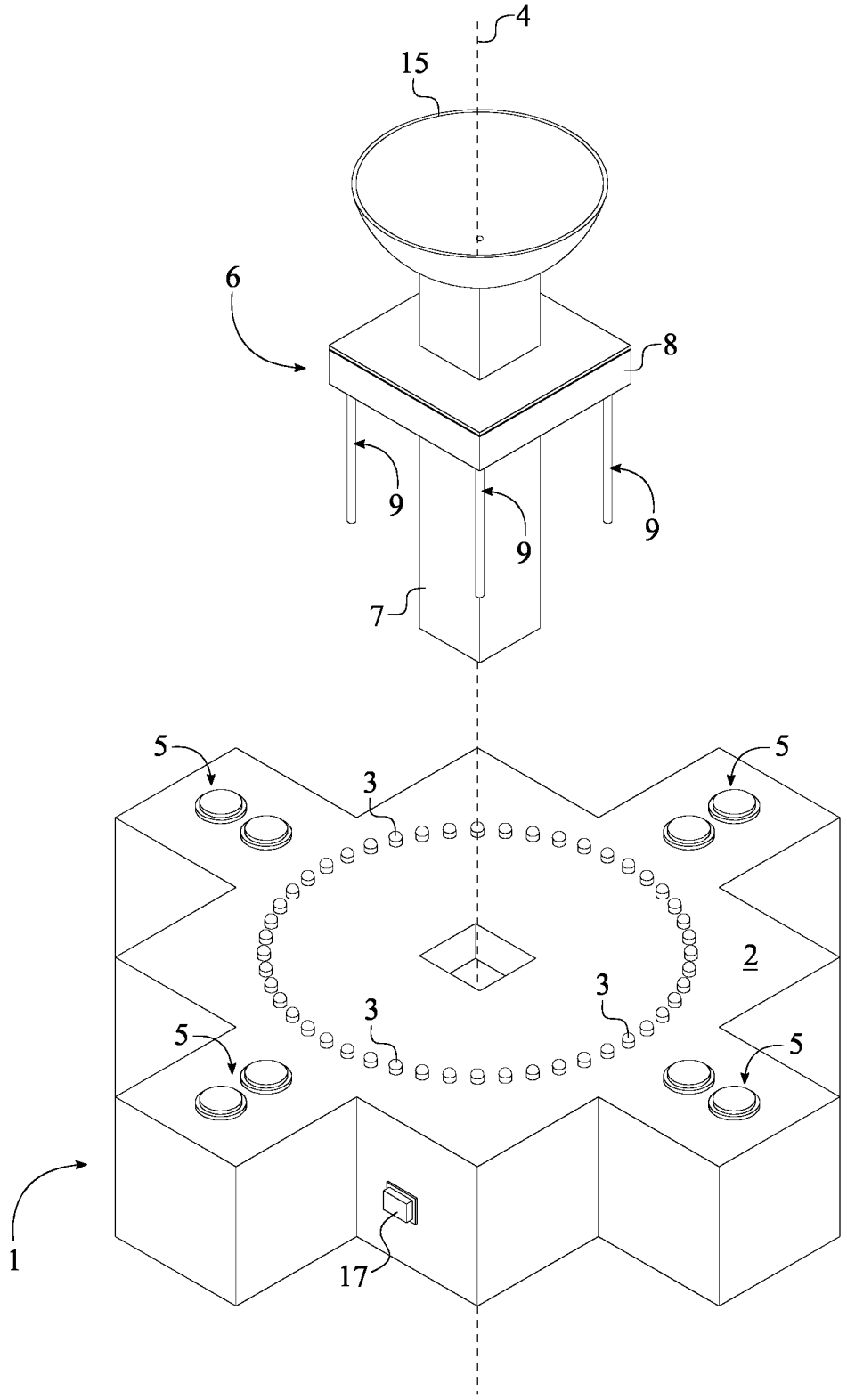
FIG. 2 is an exploded perspective view of the present invention, wherein the base and the tower are separated from each other.

In reference to the general configuration of the present invention, as shown in FIG. 1-2, the tower 6 is concentrically attached to the base 1 as the base 1 provides the designated playing area for the present invention. The reservoir 15 is concentrically connected to the tower 6 and positioned opposite of the base 1 so that the reservoir 15 can be filled with any type of consumable beverage. The plurality of dispensing units 9 is radially mounted around the tower 6 so that the stored beverage can be automatically dispensed according to the input commands of the players. In order to facilitate the dispensing of the stored beverage, the plurality of dispensing units 9 is in fluid communication with the reservoir 15. The power source 18 is electrically connected to the plurality of dispensing units 9 and the microcontroller 16 so that the present invention can be electrically powered. The microcontroller 16 is electronically connected to the plurality of dispensing units 9 so that the dispensing of the stored beverage can be controlled according to the rules and regulations of the game.

Figure 3:
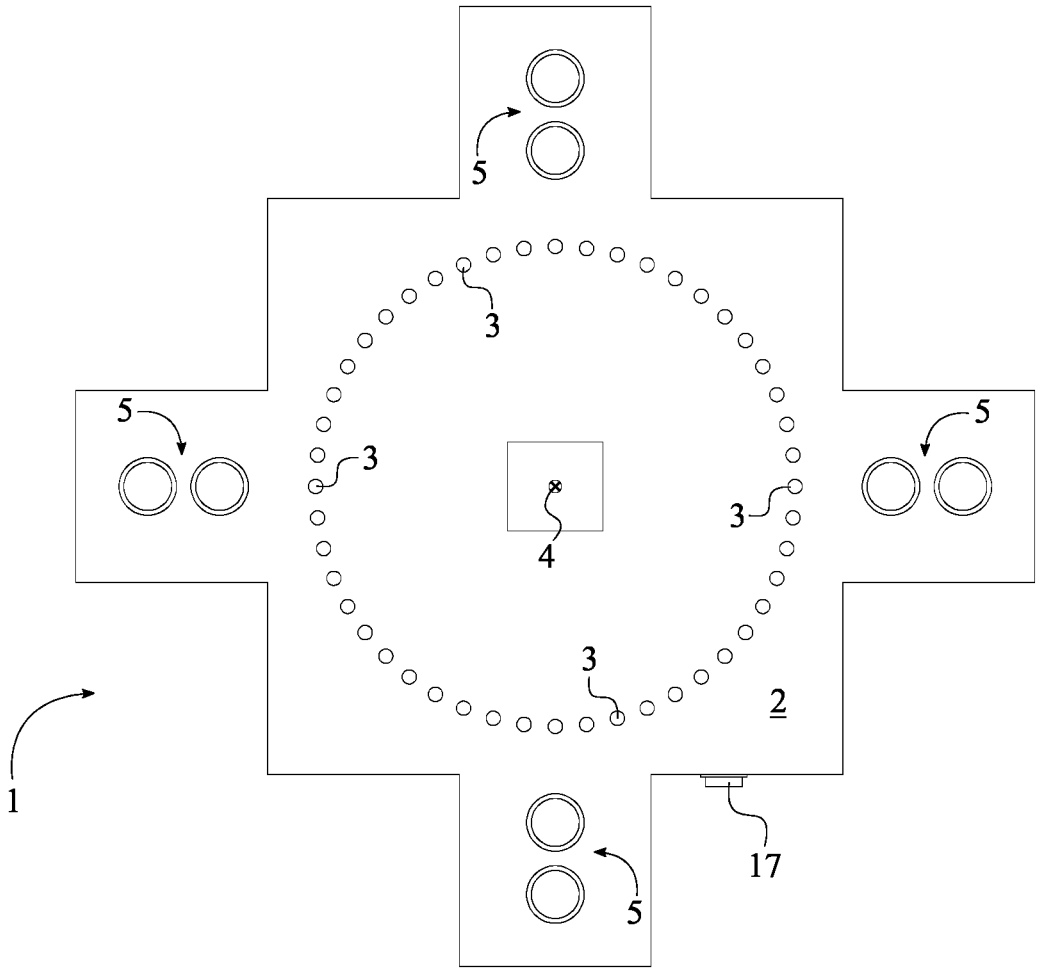
FIG. 3 is a top view of the base of the present invention.

The base 1 that provides separate playing stations for each of the players comprises a top surface 2, a plurality of light-emitting diode (LED) lights 3, a central axis 4, and a plurality of paired control buttons 5 as shown in FIG. 1-3. The central axis 4 concentrically traverses normal to the top surface 2 as a reference line so that the some of the components of the base 1 can be explained in relation of the central axis 4. More specifically, the plurality of LED lights 3 is radially positioned around the central axis 4 and connected onto the top surface 2. In other words, the plurality of LED lights 3 is positioned in front of the each playing station in a circular manner. As a result, the plurality of LED lights 3 is able to visually indicate different outcomes of the game to the players. The plurality of paired control buttons 5 is radially positioned around the central axis 4 and connected onto the top surface 2 thus allowing the players to enter their input commands during the game.

Figure 6:
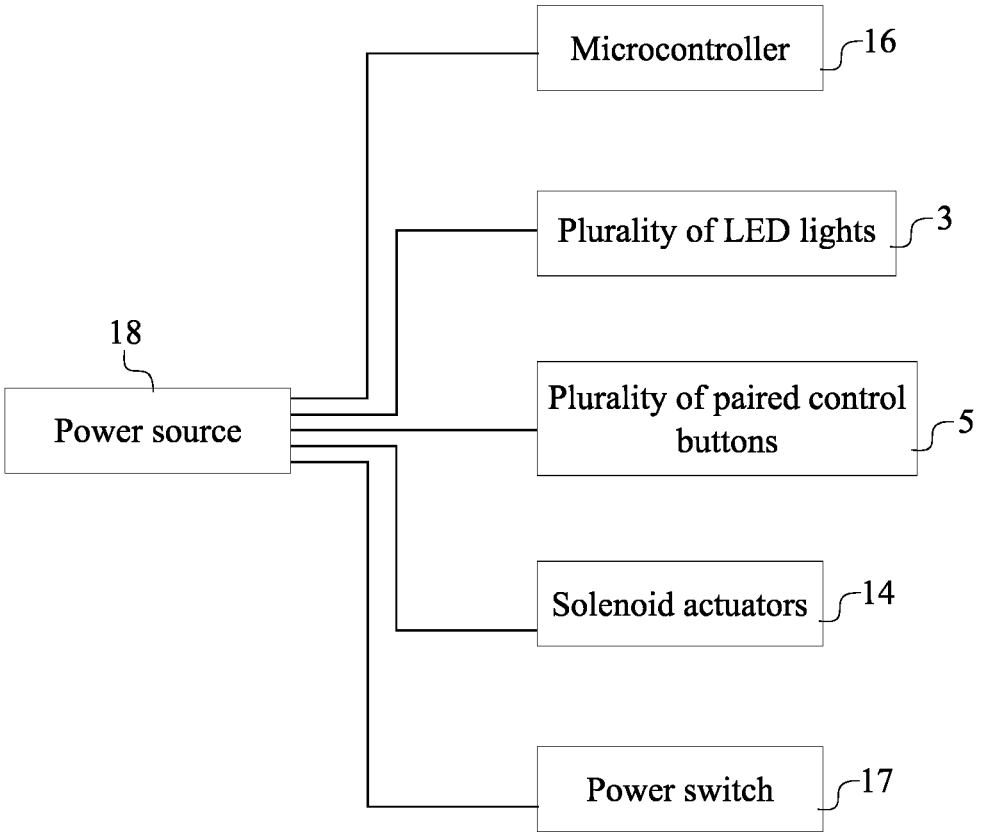
Figure 7:
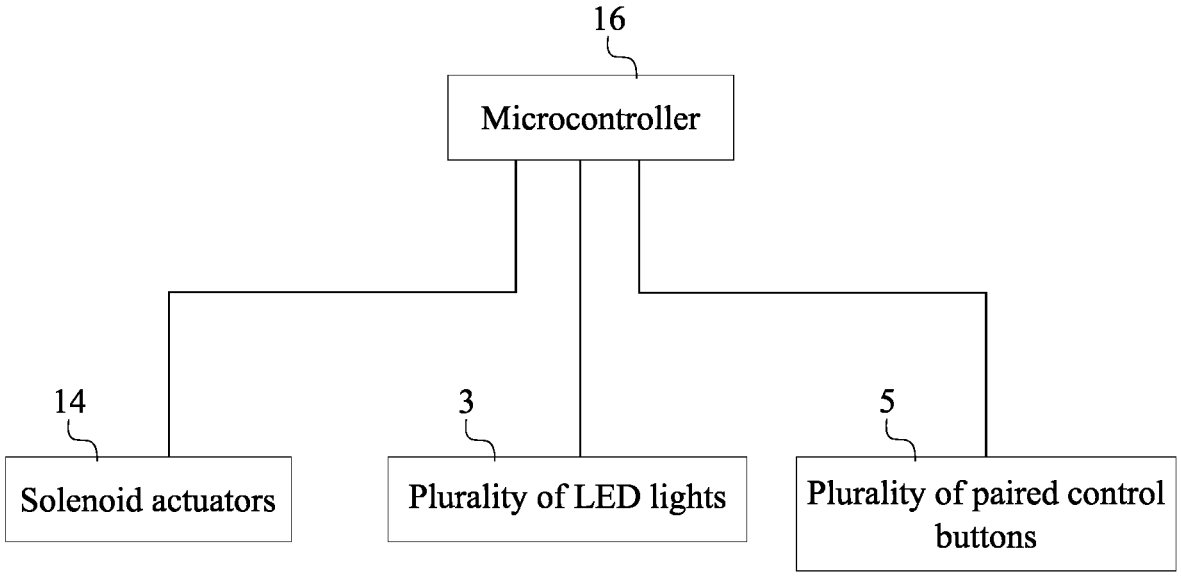
FIG. 7 is a schematic view showing the electronical connections of the present invention.

In reference to FIG. 6-7, the plurality of paired control buttons 5 is electrically connected to the power source 18. As a result, when players are prompted to press a specific button from each of the plurality of paired control buttons 5 as an input command, the corresponding button for each player is illuminated so that the players can easily identify the corresponding button that needs to be pressed. When a player presses the corresponding button from the plurality of paired control buttons 5 as an input command, the corresponding button stays illuminated so that the remaining players can easily identify which player has entered the input command. The plurality of paired control buttons 5 is electronically connected to the microcontroller 16 so that the input command from the specific button can be processed and executed through the microcontroller 16 according to the rules of the rules and regulations of the game. Furthermore, at least one button in each of the plurality of paired control buttons 5 is be colored differently to indicate different players of the game. For example, one control button from a first set of the plurality of paired control buttons 5 is colored red while another control button from a second set of the plurality of paired control buttons 5 is colored yellow so that the players can be easily differentiated from each other.

In reference to FIG. 6-7, the plurality of LED lights 3 is electrically connected to the power source 18 and electronically connected to the microcontroller 16 so that the plurality of LED lights 3 can be illuminated with respect to the input commands of the plurality of paired control buttons 5 and the output commands of the microcontroller 16. The plurality of LED lights 3 displays different colors and different illumination patterns with respect to the output commands so that the players of the present invention are able to separately identify different outcomes of the game.

The microcontroller 16 functions as the processor core of the present invention. More specifically, the microcontroller 16 is programmed with the rules and regulations of the game so that any input commands from the players can be processed and executed according to the rules and regulations. As a result, the microcontroller 16 is able to facilitate the operation of the plurality of LED lights 3, the plurality of dispensing units 9, and the plurality of paired control buttons 5. The microcontroller 16 is preferably mounted within the base 1 to protect from any foreign elements.

Figure 4:
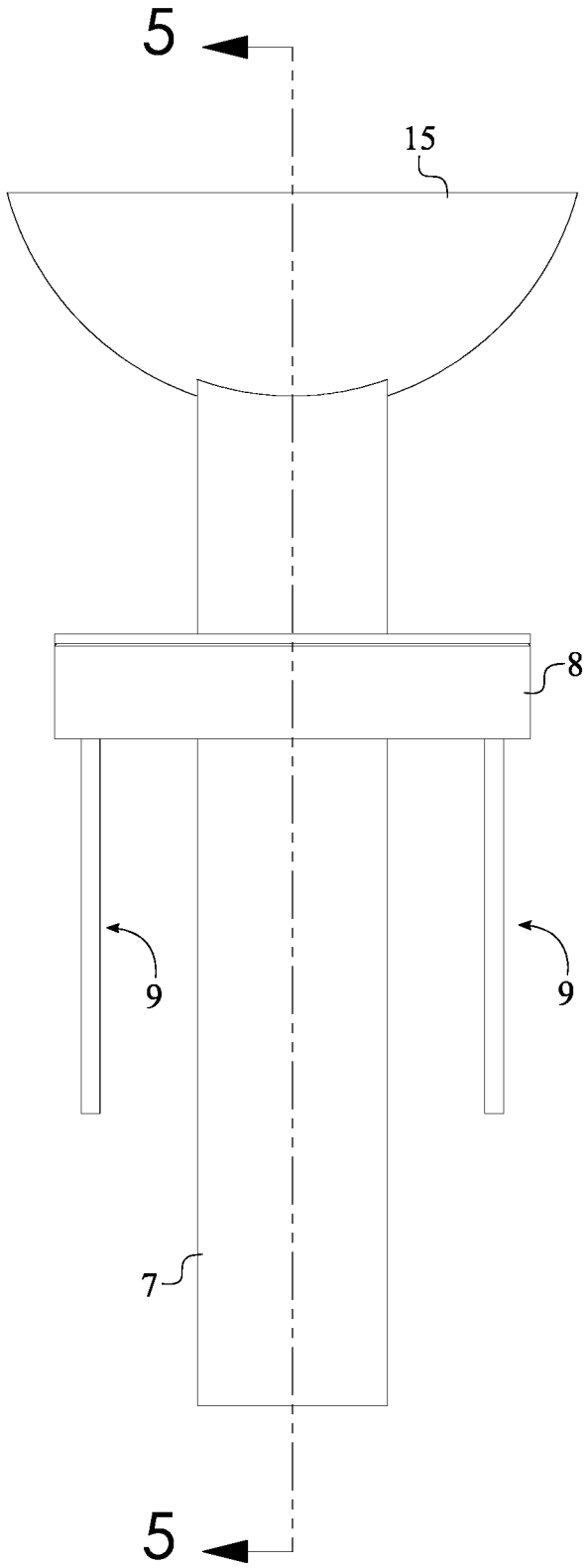
FIG. 4 is a side view of tower of the present invention, showing the plane upon which a cross sectional view is taken shown in FIG. 5.

The tower 6 functions as the intermediate member between the base 1 and the reservoir 15 so that the reservoir 15 can be elevated from the base 1. In reference to FIG. 2 and FIG. 4, the tower 6 comprises a support 7 and a housing 8. More specifically, the housing 8 is adjacently connected to the support 7 so that the plurality of dispensing units 9 can be radially mounted within the housing 8. As a result, the housing 8 is able to protect the plurality of dispensing units 9 from any beverage spillage or any other types of foreign objects. The support 7 is concentrically attached into the base 1 so that the housing 8 can be positioned atop the top surface 2 of the base 1. The height of the support 7 allows each player to place a cup below each of the plurality of dispensing units 9 so that the automatic dispensing of beverage can be collected according to the outcomes of the game. As explained in the preferred embodiment of the present invention, the tower 6 is attached into the base 1 so that the present invention can be easily shipped and stored away as the base 1 and the tower 6 can be separated into two components. However, in some embodiment of the present invention, the base 1 and the tower 6 can also be connected to each other as a singular component.

In reference to FIG. 1-2, the reservoir 15 provides the necessary storage area for the beverage to be stored. Furthermore, the top of the reservoir 15 is kept open so that the atmospheric air pressure can be applied to the stored beverage during the dispensing process to allow the liquid to flow downwards towards the base 1. The stored beverage for the present invention can be water, soda, juice, liquor, beer, wine, whiskey, or any other type of consumable liquid.

Figure 5:
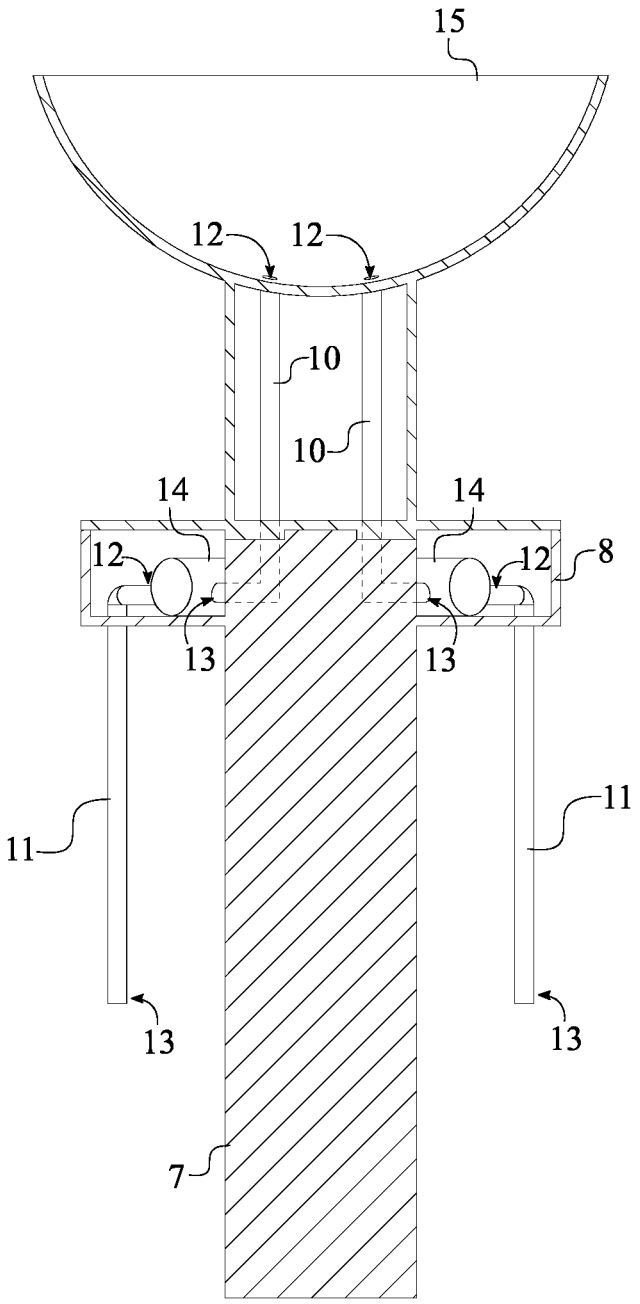
FIG. 5 is a cross section view of tower of the present invention taken along line 5-5 of FIG. 6 is a schematic view showing the electrical connections of the present invention.

Each of the plurality of dispensing units 9 enables the automatic dispensing of beverage according to the outcomes of the game. Furthermore, the number of dispensing units of the present invention is equal to the number of paired control buttons. For example, when some embodiment of the present invention supports only four players, base 1 is equipped with four sets of paired control buttons and the tower 6 is equipped with four dispensing units. In reference to FIG. 5, each of the plurality of dispensing units 9 comprises an inlet tube 10, a solenoid actuator 14, and an outlet tube 11. More specifically, a first end 12 of the inlet tube 10 is in fluid communication with the reservoir 15 so that the stored beverage can be discharged from the reservoir 15. A second end 13 of the inlet tube 10 is in fluid communication with the solenoid actuator 14 to control the flow of the stored beverage. A first end 12 of the outlet tube 11 is in fluid communication with the solenoid actuator 14 so that the beverage flow from the reservoir 15 can discharge into the outlet tube 11 through the solenoid actuator 14. A second end 13 of the outlet tube 11 is positioned offset from the base 1 thus allowing a cup to be placed below. For example, when the solenoid actuator 14 is in an opened position, the stored beverage from the reservoir 15 flows into the inlet tube 10, travels through the solenoid actuator 14, and into the outlet tube 11 so that a quantity of stored beverage can be dispensed into a cup via the gravitational force. When the solenoid actuator 14 is in a closed position, the stored beverage from the reservoir 15 flows into the inlet tube 10 but does not flows through the outlet tube 11 as the solenoid actuator 14 restricts the flow of beverage.

In order to switch between the opened position and the closed position of the solenoid actuator 14, the power source 18 is electrically connected to the solenoid actuator 14 and the microcontroller 16 is electronically connected to the solenoid actuator 14 as shown in FIG. 6-7. As a result, the present invention is able to restrict or automatically dispense the stored beverage according to the rules and regulations of the game.

In reference to FIG. 1 and FIG. 6, the present invention further comprises a power switch 17 that is integrated into the base 1. The power switch 17 is electrically connected to the power source 18 so that the players can turn on the present invention before playing a game or turn off the present invention after playing a game.

The power source 18 provides necessary electrical energy to power some of the electrical components of the present invention. The power source 18 of the present invention can be an integrated rechargeable battery that is housed within the base 1, at least one disposable battery that is removable placed within the base 1, or an external alternating current with integrated alternating current to direct current converter.

The present invention further comprises a cleaning button. The cleaning button is preferably mounted to the base 1 so that the players can easily access the cleaning button when necessary. More specifically, the cleaning button allows the plurality of dispensing units 9 and the reservoir 15 to be cleaned when necessary. The cleaning button is electrically connected to the power source 18 and electronically connected to the microcontroller 16. In order to initiate the cleaning process, the reservoir 15 needs to be filled with water or any other type of cleaning solution wherein the activation of the cleaning button sets the plurality of dispensing units 9 into the opened position.

The method of playing the game is here in after explained in relation to the preferred embodiment that allows only four players to compete against each other. However, the same set of rules can be applied to any number of players.

Firstly, the beverage of a choice is poured into the reservoir 15 from the top, four cups are placed below the second end 13 of the outlet tubes 11, and the power switch 17 is turned on so that the players can start a game. Once the power switch 17 is turned on, a series illumination patterns make the game as simple as possible via the plurality of LED lights 3. To clearly identify each player, one notification LED light from the plurality of LED lights 3 is assigned to each player wherein the one notification LED light is directly positioned in front of each of the plurality of the paired control buttons 5 and continuously illuminated throughout the game as a stagnant red light. Furthermore, a first button of each of the plurality of paired control buttons 5 is also illuminated so that all four players are aware of which button to press during the game play.

Then, a green light is randomly illuminated within the plurality of LED lights 3 and starts to quickly circle around the plurality of LED lights 3 thus allowing any of the players to stop the green light directly in front of them so as to align the moving green light with the stagnant red notification LED light. The circling of the green light can be stopped by any player with the first button. If a specific player is skilled and able to stop the green light in the place of the stagnant red light, the plurality of LED lights 3 flashes a rainbow color display that wraps around the plurality of LED lights 3 to demonstrate "a winner" sequence thus indicating that the specific player is the winner of that round. At the same time, illumination of the first button for the remaining three players terminates, indicating gameplay mode has stopped. When the rainbow color display stops, the plurality of paired control buttons 5 that is designated only to the winner stays illuminated. Then, the winner is able to select any player from the remaining three players to drink the stored beverage. Each time the winner presses the second button of the paired control buttons 5, the selection of the player to drink the stored beverage changes clockwise. The player for which the selection is about to be made is indicated by the illumination of three LED lights from the plurality of LED lights 3 which is centered on a specific player's notification LED. The three aforementioned LED lights are illuminated with the same color as the paired control buttons 5 of the player who won the previous round and is now making the selection of who receives the beverage. When the winner is ready to make the selection, the winner presses the first button of the plurality of paired control buttons 5. Then, the selected player's notification LED light changes into red color from the matching paired control buttons 5 color while activating the corresponding dispensing unit of the selected player. More specifically, the solenoid actuator 14 of the corresponding dispensing unit switches from the closed position into the opened position. As a result, a quantity of stored beverage pours from the reservoir 15 to the cup. Once the pouring of the stored beverage is completed, the solenoid actuator 14 closes thus halting the beverage flow so that the selected player can then remove the cup for consumption of the beverage. The selected player is indicated to take a drink by the three illuminated LED lights centered around the notification LED light turning from red to green. After a short delay, the three aforementioned LED lights turn off and the four notification LED lights are illuminated with red color indicating a new round of game has started.

The game starts the new round as a green light randomly illuminated within the plurality of LED lights 3 starts to quickly circle around the plurality of LED light at a random speed. When a specific player tries again to stop the circling of the green light but fails to stop it in the place of the stagnant red light, the game pauses for a short time to show how far off the specific player is from the stagnant red light. Then, the plurality of LED lights 3 flashes in red color demonstrating "a loser" sequence. After the demonstration of the loser sequence, the three LED lights centered on the player's notification LED light illuminate red and a quantity of stored beverage is poured into the specific player's cup. After the pouring of the stored beverage, the cup can be removed for consumption of the beverage, once again indicated by the three red LED lights changing to a green color.

Furthermore, the present disclosure "on fire" game feature to improve the competitiveness. From round to round, the present invention keeps track of the winner of the previous rounds. For example, when a specific player wins two rounds without losing, five LED lights of the plurality of LED lights 3 centered on the player's notification light illuminate orange to indicate the rest of the players that the specific player has won two in a row. When the specific player wins three rounds in a row, eleven LED lights of the plurality of LED lights 3 centered on the player's notification light illuminate in flashing orange/red color to indicate the rest of the player that the specific player has won three in a row. If any player wins three rounds in a row, the present invention pours the stored beverage in a larger quantity than usually prescribed to the player chosen by the winner to receive the beverage.

If a given round is designated the fastest random speed, then an additional reward is possible for an added challenge. When a player succeeds in stopping the circling green LED light on the notification light during the fastest speed, the player is rewarded by all three other players receiving a beverage from the dispensing unit instead of just the standard one player.

Although the invention has been explained in relation to its preferred embodiment, it is to be understood that many other possible modifications and variations can be made without departing from the spirit and scope of the invention as hereinafter claimed.

What is claimed is:

1. A tabletop drinking game apparatus comprising:
- a base;
- a tower;
- a plurality of dispensing units;
- a reservoir;
- a microcontroller;
- a power source;
- the tower being concentrically attached to the base;
- the reservoir being concentrically connected to the tower, opposite of the base;
- the plurality of dispensing units being radially mounted around the tower;
- the plurality of dispensing units being in fluid communication with the reservoir;
- the power source being electrically connected to the plurality of dispensing units and the microcontroller;
- the microcontroller being electronically connected to the plurality of dispensing units;
- the base comprising a top surface, a plurality of light-emitting diode (LED) lights, a central axis, and a plurality of paired control buttons;
- the central axis concentrically traversing normal to the top surface;
- the plurality of LED lights being radially positioned around the central axis;
- the plurality of LED lights being connected onto the top surface;
- the plurality of paired control buttons being radially positioned around the central axis; and
- the plurality of paired control buttons being connected onto the top surface.

2. The tabletop drinking game apparatus as claimed in claim 1 comprising:
- the plurality of LED lights being electrically connected to the power source; and
- the plurality of LED lights being electronically connected to the microcontroller.

3. The tabletop drinking game apparatus as claimed in claim 1 comprising:
- the plurality of paired control buttons being electrically connected to the power source; and
- the plurality of paired control buttons being electronically connected to the microcontroller.

4. The tabletop drinking game apparatus as claimed in claim 1 comprising:
- the tower comprising a support and a housing;
- the housing being adjacently connected to the support;
- the support being centrically attached into the base; and
- the plurality of dispensing units being radially mounted within the housing.

5. The tabletop drinking game apparatus as claimed in claim 1 comprising:

each of the plurality of dispensing units comprising an inlet tube, a solenoid actuator, and an outlet tube;

a first end of the inlet tube being in fluid communication with the reservoir;

a second end of the inlet tube being in fluid communication with the solenoid actuator;

a first end of the outlet tube being in fluid communication with the solenoid actuator; and a second end of the outlet tube being positioned offset from the base.

6. The tabletop drinking game apparatus as claimed in claim 5 comprising:

the solenoid actuator being electrically connected to the power source; and the solenoid actuator being electronically connected to the microcontroller.

7. The tabletop drinking game apparatus as claimed in claim 1 comprising:

a power switch;

the power switch being integrated into the base; and the power switch being electrically connected to the power source.

* * * * *